US005685027A

United States Patent [19]

Jensen

[11] Patent Number: 5,685,027

[45] Date of Patent: Nov. 11, 1997

[54] SIPHONIC FLUSH VALVE FOR TOILETS

[75] Inventor: Robert M. Jensen, East Burnswick, N.J.

[73] Assignee: American Standard Inc., Piscataway, N.J.

[21] Appl. No.: 618,678

[22] Filed: Mar. 20, 1996

[51] Int. Cl.[6] ..... E03D 1/08

[52] U.S. Cl. ..... 4/373; 4/368

[58] Field of Search ..... 4/368, 369, 373, 4/353

[56] References Cited

U.S. PATENT DOCUMENTS

| | | | |
|---|---|---|---|
| 1,173,631 | 2/1916 | Zwermann | 4/353 |
| 1,263,660 | 4/1918 | Gove | 4/373 |
| 1,333,269 | 9/1920 | Metcalf | 4/373 |
| 3,358,295 | 12/1967 | Wolfgram . | |
| 3,851,338 | 12/1974 | Roosa | 4/373 |
| 4,268,924 | 5/1981 | Price et al. . | |
| 5,140,712 | 8/1992 | Wang-On . | |

*Primary Examiner*—David J. Walczak

*Attorney, Agent, or Firm*—Ann M. Knab; Elaine Brenner Robinson

[57] ABSTRACT

A siphonic flush valve for a toilet having a toilet tank and toilet bowl. The valve includes a housing supportable in the toilet tank and defines a chamber, an upleg open to the chamber and a downleg open to the upleg. The chamber includes a manually actuatable piston system slideably supported therein for forcing water in the chamber into the upleg. The flush valve also includes an adjustable check valve and a vent and reseal tube.

4 Claims, 6 Drawing Sheets

SIPHONIC FLUSH VALVE FOR TOILETS

BACKGROUND OF THE INVENTION

The present invention relates generally to a siphonic flush valve for toilets and, in particular, to a siphonic flush valve which uses a manually actuated biased piston system to initiate the flushing of a toilet through siphonic action. The siphonic flush valve incorporates improved features including an adjustable check valve and a combined vent and reseal tube to enhance the flushing characteristics of the valve.

Toilets which utilize siphonic flush valves are generally known in the art and are more commonly used in European countries and other countries foreign to the United States due to different plumbing and sanitary codes and standards applicable there. For example, European toilet bowl designs generally have open rims on the bowl and small water spots that generally do not require additional water to reseal the trapway. Toilet designs used in the United States have ported rim areas and larger water spots that generally require additional water to ensure full reseal of the trapway and large water spot.

U.S. Pat. No. 5,140,712 to Wang-On discloses a siphon-operated water tank for a flushing system which incorporates a manually actuated piston system to initiate the siphon flush of a toilet. Wang-On describes an elaborate system for use with the siphon flush valve system which allows two different volumes of flush water depending on the waste to be discharged from the bowl.

U.S. Pat. No. 4,268,924 to Price, et al. discloses a siphon-operated closet bowl flush tank of the piston-actuated type. Price, et al. includes a system for permitting a light or heavy flush, again depending on the amount of waste to be discharged from the toilet bowl.

Because toilets come in many shapes and sizes with different flushing characteristics and water requirements, a siphonic flush valve system which is adaptable for use in the toilet tanks of different toilets and which allows for adaptability to such different toilets, while providing reseal water to the bowl or trapway to ensure appropriate resealing of the trapway, is highly desirable. The present invention provides such a system and construction.

SUMMARY OF THE INVENTION

Generally speaking, in accordance with the present invention, a siphonic flush valve for a toilet having a toilet tank and toilet bowl is provided. The flush valve includes a housing supportable in the tank which defines an internal chamber and a passageway defining an upleg open to the chamber and a downleg which directs water to the toilet bowl. A piston is slideably disposed in the chamber and is manually actuatable when a handle on the toilet is pressed to initiate siphon action by causing water in the chamber to be forced up the upleg and down the downleg of the valve. The chamber further includes an opening, with a check valve movably supported in the opening. The height of the check valve can be manually adjusted in the opening to adjust the flushing characteristics of the valve.

The siphonic flush valve of the present invention may further include a vent and reseal tube formed as part of the housing which defines a separate passageway for reseal water to be supplied to the bowl during the flushing cycle to ensure that the trapway is properly resealed to prevent the escape of harmful sewer gases. An air gap is preferably provided between the vent and reseal tube and a reseal water hose to eliminate any pressure differential between the toilet tank and flush valve body to prevent inadvertent recycling or restarting of a siphonic flush after refill is complete.

Accordingly, it is an object of the present invention to provide an improved siphonic flush valve for toilets.

Another object of the present invention is to provide an improved siphonic flush valve for toilets which includes a manually actuated biased piston system for initiating the flush cycle.

A further object of the present invention is to provide a siphonic flush valve for toilets which includes a movably or slideably adjustable check valve to allow adaptation of the flush valve to various toilet types and sizes.

Yet another object of the present invention is to provide a siphonic flush valve for toilets which includes a vent and reseal tube which defines a separate passageway for reseal water to enter the toilet bowl.

A still further object of the present invention is to provide a siphonic flush valve for toilets having an integrally formed housing which forms the chamber, upleg, downleg and vent and reseal tube.

Still objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
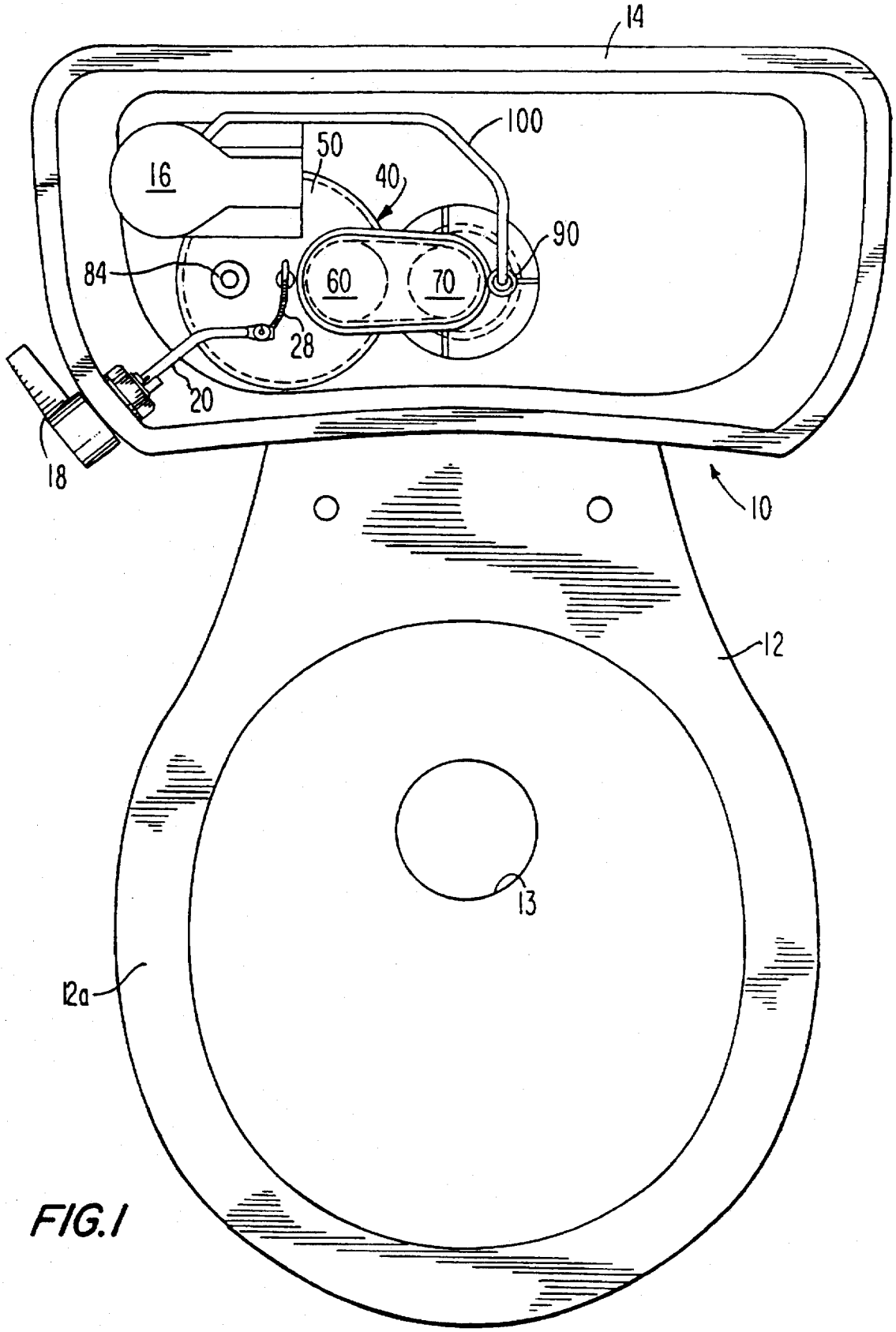
FIG. 1 is a top plan view of a toilet which includes a siphonic flush valve constructed in accordance with a preferred embodiment of the present invention.

Reference is first made to FIG. 1 which depicts a toilet, generally indicated at 10, which includes a toilet bowl 12 and a toilet tank 14. Toilet bowl 12 includes a rim portion **12*a* which generally includes a plurality of openings on the underside thereof (not shown) to allow water from tank 14 to flush the contents of bowl 12 after use, and to allow for rinsing of the inner wall thereof. Toilet bowl 12 also includes an opening 13** which leads to a trapway which in turn leads to the sewer line for waste disposal.

Tank 14 is adapted to hold a supply of fresh water which is supplied under siphon action to toilet bowl 12 after a flush has been initiated. Toilet tank 14 includes a water control device 16 which allows fresh water under mains pressure to be supplied to tank 14 during the flush cycle. Tank 14 also includes a rotatable handle 18 on the outside of tank 14 which is coupled to a flush activation arm 20 in tank 14 which rotates with handle 18. Also situated in tank 14 is a siphonic flush valve, generally indicated at 40, and constructed in accordance with a preferred embodiment of the present invention.

Figure 2:
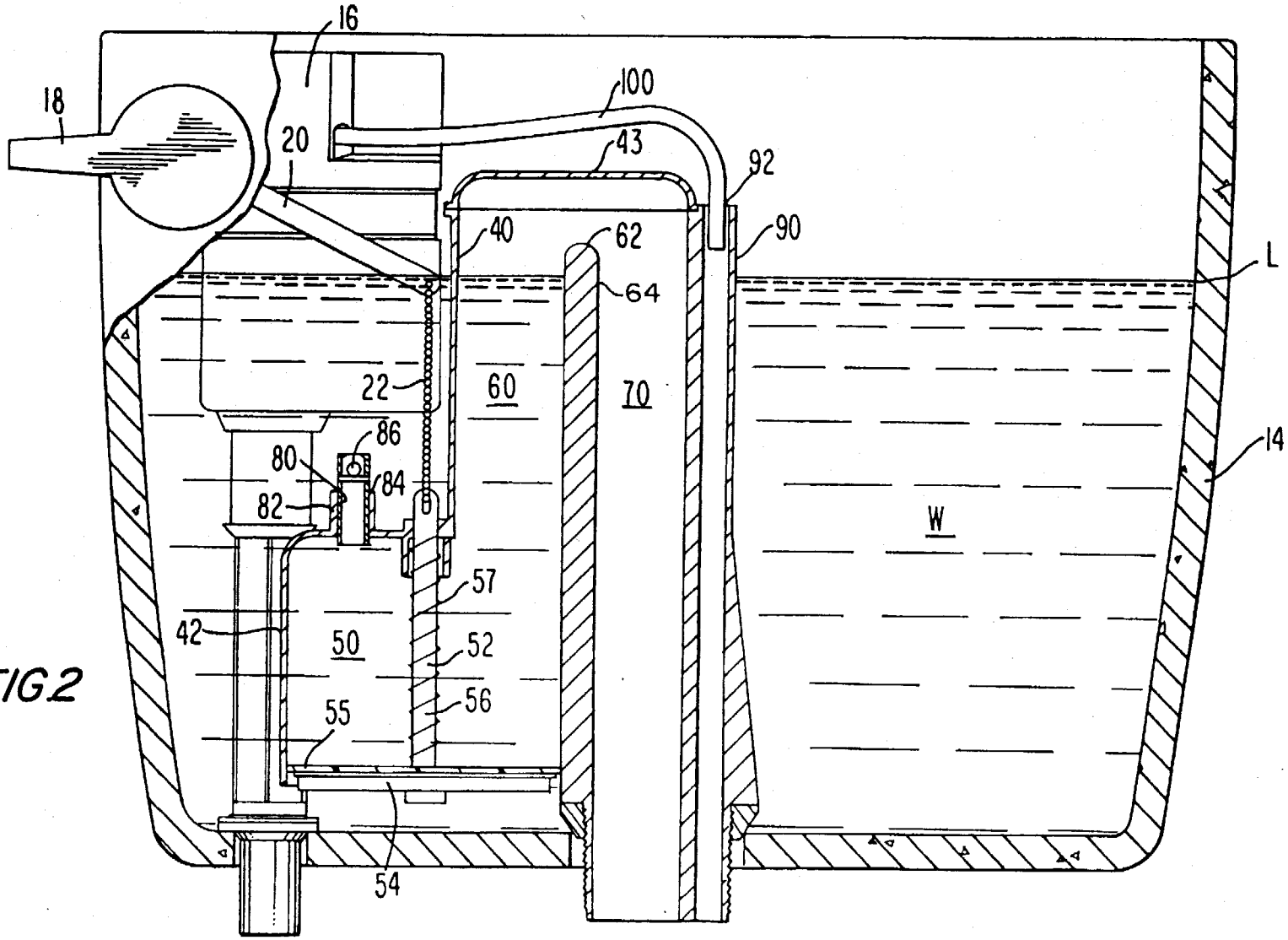
FIG. 2 is a front elevational sectional view of the toilet tank depicted in FIG. 1 showing the construction of the siphonic flush valve of the present invention.

Referring now additionally to FIG. 2, it is seen that flush valve 40 includes a housing 42 which defines a bell chamber 50, an upleg 60 and a downleg 70. Housing 42 is preferably integrally formed from a thermoplastic material. A separate cap 43 may be used to close off the top of the U-shaped passageway formed by upleg 60 and downleg 70.

Bell chamber 50 includes a piston actuation system 52 which includes a piston disk 54 having openings therein to allow water to flow therethrough, and a piston rod 56 which is coupled to piston disk 54. A flexible valve disk 55 also formed of plastic material is supported on piston disk 54 as depicted to form a one-way type valve. A return spring 57 is provided to normally bias piston disk 54 in the lower position depicted in FIG.2. A beaded chain or flexible member 22 or the like couples flush actuation arm 20 to piston rod 56.

Bell chamber 50 includes an opening 80 defined by an upstanding collar 82. A check valve 84 is frictionally engaged in collar 82 and is slidable with respect thereto to permit adjustment of the flush characteristics of the valve. It is noted that other configurations, such as a threaded arrangement, may be used to provide a movably adjustable check valve. Check valve 84 includes a ball 86 or other movable closing device captured in the upper portion thereof. The height of check valve 84 can be manually adjusted, as described below, to provide different flushing characteristics to the tank and to allow the valve to be adaptable to different toilets.

Housing 42 also includes a vent and reseal tube 90 which, as described below, provides a separate passageway for fresh water to enter toilet bowl 12 during the flush cycle to ensure a proper trapway reseal. A reseal water hose 100 coupled to water control 16 extends into vent and reseal tube 90, while providing an air gap 92 therebetween.

FIG. 2 depicts the static nature of the toilet tank and siphonic flush valve of the present invention before a flush cycle is initiated. Fresh water W fills tank 14 to a predetermined level indicated by the letter L. Water W fills bell chamber 50 and a portion of upleg 60, as depicted. The water level L is lower than the weir 62 defined by the top surface of wall 64 separating upleg 60 from downleg 70. Ball 86 in check valve 84 is positioned as depicted in FIG. 2 to leave the check valve open to flow.

Figure 3:
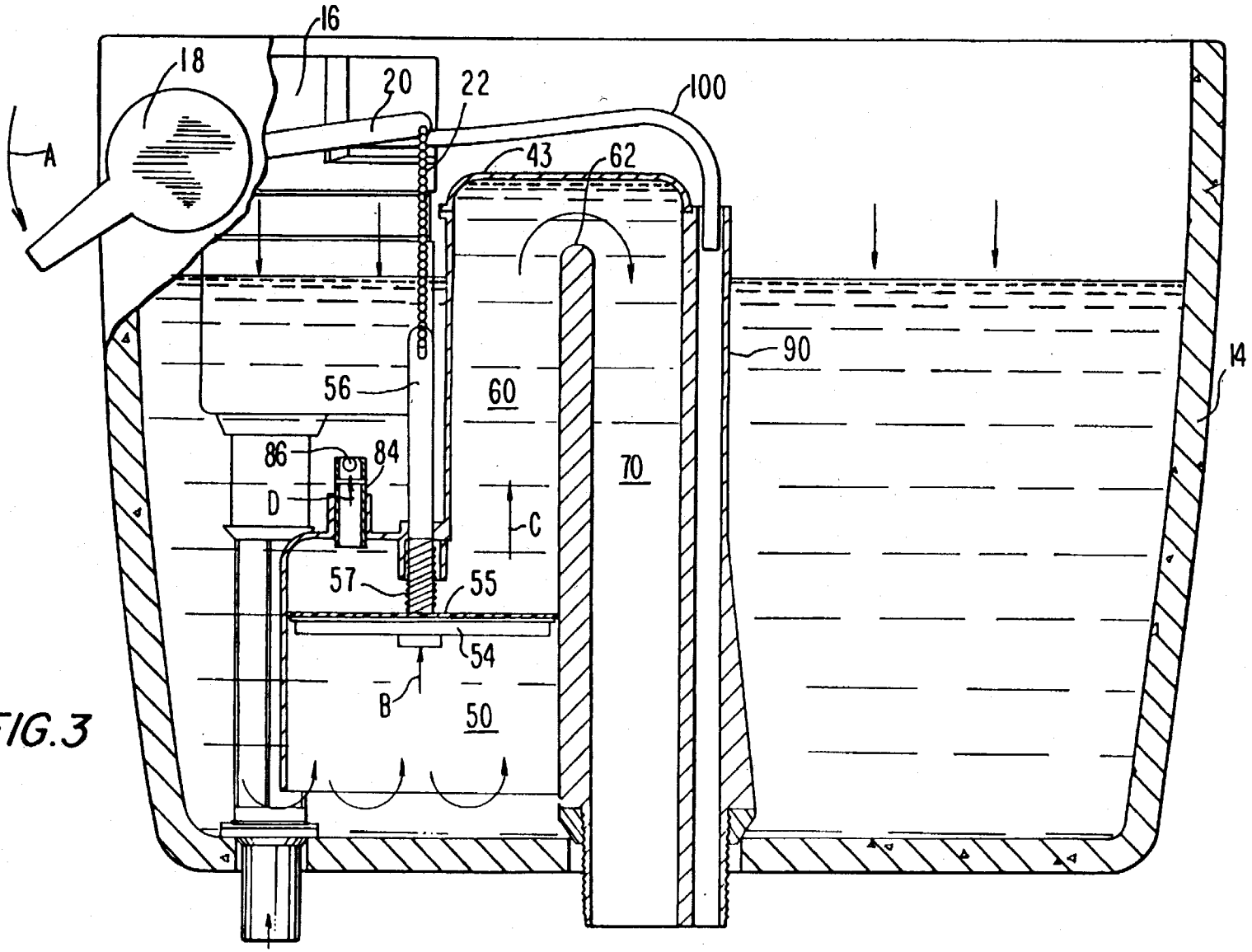
FIG. 3 is a sectional view similar to FIG. 2 but showing the condition of the siphonic flush valve of the present invention after a flush has been initiated.

Reference will now be made additionally to FIGS. 3 through 6 to describe the flushing action of a toilet incorporating the siphonic flush valve of the present invention. Referring specifically to FIG. 3, it is seen that when handle 18 is pressed or rotated in the direction of arrow A, actuation arm 20 is lifted thereby causing chain 22 to pull up on piston rod 56 raising piston disk 54 and flexible valve plate 55 in the direction of arrow B. Spring 57 is compressed as depicted. This upward action forces water in bell chamber 50 upwardly in the direction of arrow C into upleg 60 causing the water to rise above weir 62 thereby causing water to enter downleg 70 to start the siphonic flush action. Downleg 70 leads to toilet bowl 12 so that as water flows down downleg 70, it enters bowl 12 to start the flushing thereof.

The upward movement of water caused by the upward movement of piston disk 54 forces the water in an upward direction in check valve 84. This acts to move ball 86 in an upward direction indicated by arrow D to close check valve 84. This action prevents fluid loss to the tank through the valve and utilizes maximum fluid volume in the upleg and bell chamber to establish siphonic action.

Figure 4:
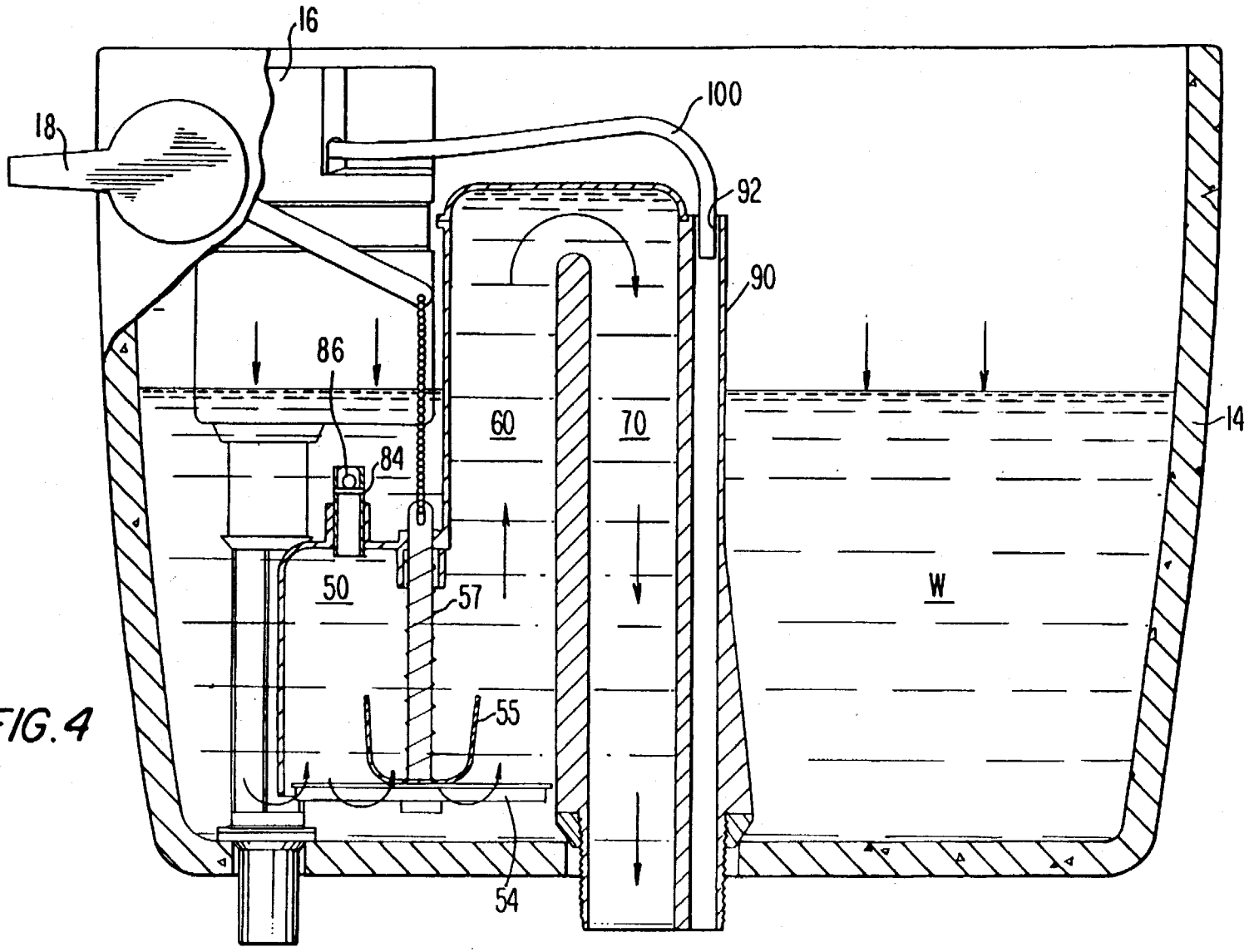
FIGS. 4 through 6 are sectional views similar to FIGS. 2 and 3 but showing further development of the flushing action of the siphonic flush valve of the present invention.

When handle 18 is released as depicted in FIG. 4, piston plate 54 will return to its original lower position due to the downward force exerted by spring 57. However, due to the flexible nature of flexible valve plate 55, plate 55 will deform and allow water to continue flowing into bell chamber 50, up upleg 60, and down downleg 70. Siphonic flush action proceeds as the water in tank 14 continues to drain through piston plate 54 and bell chamber 50. Since the upward water pressure caused by upward movement of piston plate 55 is removed, ball 86 in check valve 84 opens the valve and allows water to flow therethrough.

Figure 5:
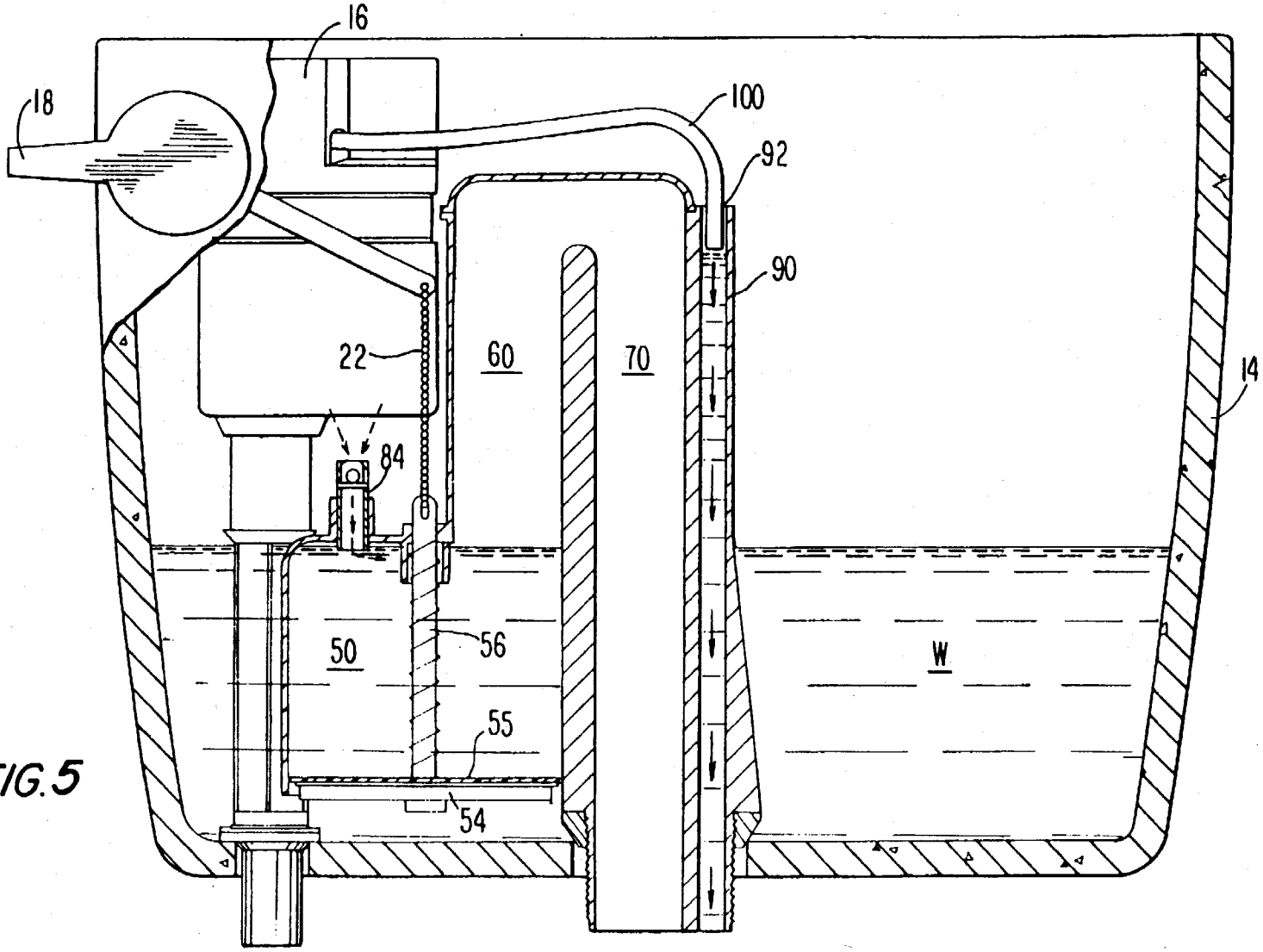

FIG. 5 depicts the continuing flush action where the level of water W drops below the level of check valve 84. At this time, air is introduced into the flush valve through the check valve which breaks the siphonic flow and stops the flow of water from upleg 60 to downleg 70. At this point, tank 14 begins to refill with fresh water under the control of water control 16.

Fresh reseal water is introduced through reseal water hose 100 into vent and reseal tube 90, as depicted. This reseal water flows into toilet bowl 12 to allow full reseal of the bowl trapway. It is specifically noted that tube 90 is constructed so that hose 100 will provide an air gap 92 with respect to vent and reseal tube 90 to eliminate any pressure differential between the flush valve and the rim chamber of the toilet bowl that could allow the siphon action to inadvertently start again once the tank is refilled.

Figure 6:
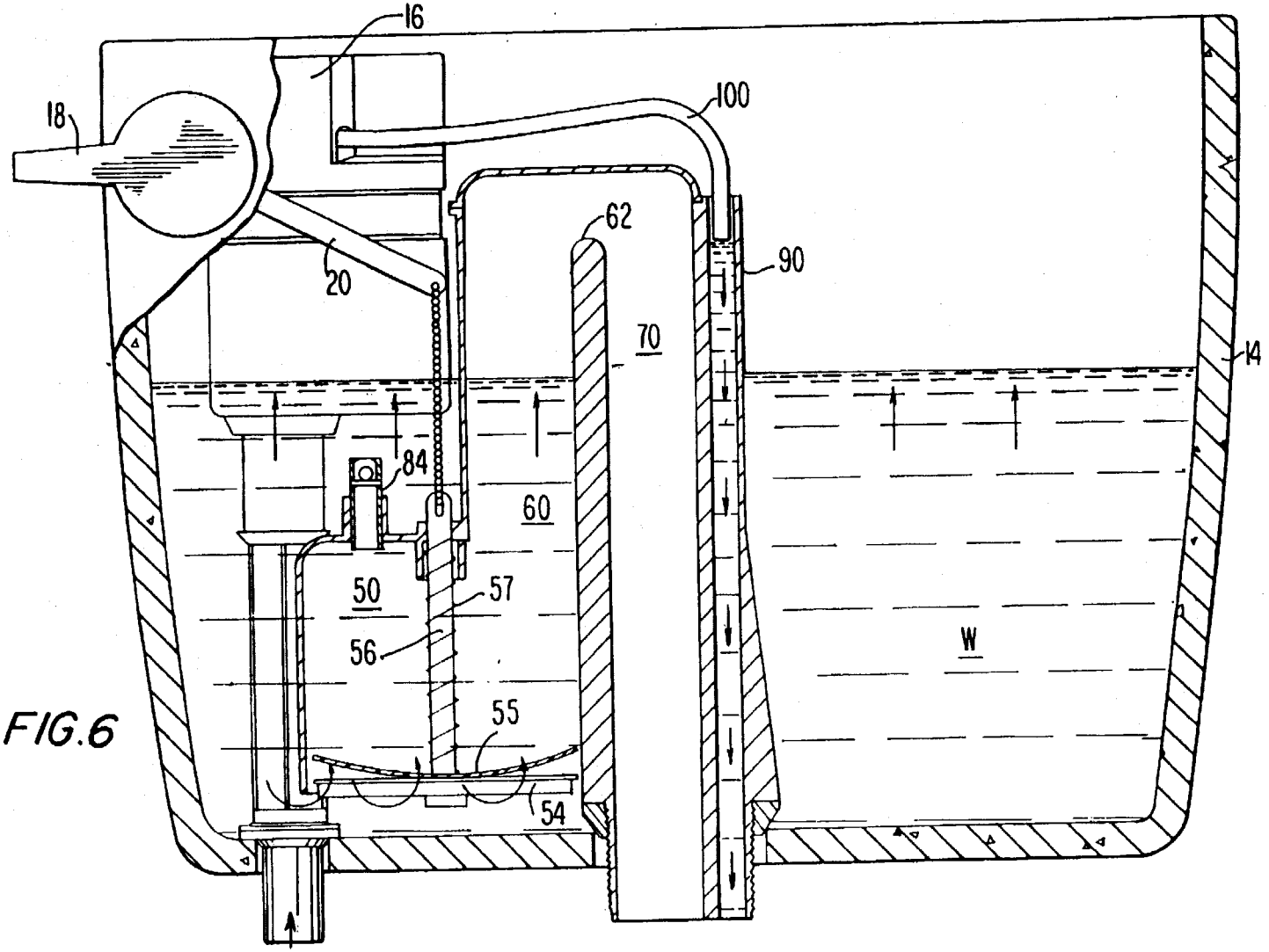

FIG. 6 depicts the situation where flushing action has ceased and tank 14 is refilling with fresh water supplied by water control 16. In this state, fresh water is supplied to tank 14 under the control of water control 16 which also continues to supply water through reseal water hose 100 to vent and reseal tube 90. Water W fills tank 14, bell chamber 50 and a portion of upleg 60. Water is allowed to flow into bell chamber 50 through open piston disk 54 and around flexible valve plate 55 which is deformed as depicted in FIG. 6 through the upward water flow. Check valve 84 is open and also allows water to flow therethrough.

When water W reaches a predetermined level as determined by water control 16, the flow of fresh water into tank 14 will cease as will the flow of fresh water through reseal water hose 100 and the system will assume the static state depicted in FIG. 2.

In accordance with the present invention as described in detail above, a siphonic flush valve with improved features and characteristics is provided. In particular, the valve includes an adjustable check valve and an integrally formed vent and reseal tube which provides a separate passageway for water to flow to the toilet bowl while at the same time providing an air gap to break any seal and prevent inadvertent siphonic action. The siphonic flush valve can be integrally formed from a thermoplastic material to provide an integral unit for installation in various sizes and types of toilets. The height of check valve 84 can be selected by the installer or user to set the position at which air will first be introduced into bell chamber 50 as the water level drops during the flushing cycle to break the siphon and stop the flushing action.

It will thus be seen that the objects set forth above, among those made apparent from the preceding description, are efficiently attained and, since certain changes may be made in the above construction without departing from the spirit and scope of the invention, it is intended all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A siphonic flush valve for a toilet, said toilet having a toilet tank and a toilet bowl, said siphonic flush valve comprising a housing supportable in said toilet tank and defining a chamber, an upleg open to said chamber and a downleg open to said upleg, said chamber including a manually actuatable piston means slideably supported therein for forcing water in said chamber into said upleg at the start of a flush cycle, said chamber further including a collar defining an opening, and a check valve movably supported in said opening, the height of said check valve being manually adjustable in said opening to control the siphonc flush action of said flush valve, said check valve includes a movable member which closes said check valve when said piston means is manually actuated to force water in said chamber, said check valve being frictionally supported in said collar to allow slidable manual adjustment of the height of said check valve, said piston including openings therein to allow water to flow therethrough.

2. The siphonic flush valve as claimed in claim 1, further comprising a vent and reseal tube on said housing which defines a separate fresh water passageway to said toilet bowl when said siphonic flush valve is supported in said toilet tank.

3. The siphonic flush valve as claimed in claim 2, wherein said vent and reseal tube defines an air gap between said toilet tank and said toilet bowl.

4. The siphonic flush valve as claimed in claim 2, wherein said housing is integrally formed from a thermoplastic material defining said chamber, upleg and downleg, said vent and reseal tube being integrally formed as part of said housing.

* * * * *